US010704354B2

(12) United States Patent
Hamid et al.

(10) Patent No.: US 10,704,354 B2
(45) Date of Patent: Jul. 7, 2020

(54) ZONAL ISOLATION OF A SUBTERRANEAN WELLBORE

(71) Applicant: Saudi Arabian Oil Company, Dhahran (SA)

(72) Inventors: Saad Hamid, Udhailyah (SA); Scott Fraser Ashby, Udhailyah (SA)

(73) Assignee: SAUDI ARABIAN OIL COMPANY (SA)

( * ) Notice: Subject to any disclaimer, the term of this patent is extended or adjusted under 35 U.S.C. 154(b) by 242 days.

(21) Appl. No.: 15/937,572

(22) Filed: Mar. 27, 2018

(65) Prior Publication Data

US 2019/0301262 A1 Oct. 3, 2019

(51) Int. Cl.

| | |
|---|---|
| ***E21B 43/26*** | (2006.01) |
| ***E21B 33/12*** | (2006.01) |
| ***E21B 29/00*** | (2006.01) |
| ***E21B 43/116*** | (2006.01) |
| ***E21B 23/01*** | (2006.01) |
| ***E21B 34/14*** | (2006.01) |

(52) U.S. Cl.

CPC ..... *E21B 33/12* (2013.01); *E21B 23/01* (2013.01); *E21B 29/00* (2013.01); *E21B 33/1204* (2013.01); *E21B 34/14* (2013.01); *E21B 43/116* (2013.01); *E21B 43/26* (2013.01)

(58) Field of Classification Search

CPC ..... E21B 33/12; E21B 23/01; E21B 29/00; E21B 33/1204; E21B 34/14; E21B 43/116; E21B 43/26

See application file for complete search history.

(56) References Cited

U.S. PATENT DOCUMENTS

| | | | |
|---|---|---|---|
| 4,637,468 | A | 1/1987 | Derrick |
| 6,394,180 | B1 | 5/2002 | Berscheidt et al. |
| 7,021,389 | B2 | 4/2006 | Bishop et al. |
| 8,127,856 | B1 | 3/2012 | Nish et al. |
| 8,540,035 | B2 | 9/2013 | Xu et al. |

(Continued)

FOREIGN PATENT DOCUMENTS

| | | | | |
|---|---|---|---|---|
| EP | 0427422 | A2 * | 5/1991 | ..... E21B 43/11 |
| EP | 0427422 | A2 | 5/1991 | |
| WO | 2014099208 | A1 | 6/2014 | |

OTHER PUBLICATIONS

The International Search Report and Written Opinion for related PCT application PCT/US2019/024322 dated Jun. 19, 2019, 14 pages.

*Primary Examiner* — Yong-Suk Ro
*Assistant Examiner* — Yong-Suk (Philip) Ro
(74) *Attorney, Agent, or Firm* — Bracewell LLP; Constance R. Rhebergen

(57) ABSTRACT

A plug assembly used in a wellbore fracturing process includes an annular housing that is set in the wellbore, and a ball that lands and seats in the housing. The housing and ball form a pressure barrier in the wellbore that isolates one portion of the wellbore from an adjacent portion. Pressurizing the portion of the wellbore isolated by the plug assembly generates fractures in a formation around that portion of the wellbore. The ball is not reactive with wellbore fluid or affected by wellbore conditions. Fluid communication across the plug assembly is reestablished by fracturing or milling the ball within the housing. Wellbore operations are conducted by inserting downhole tools through a bore axially formed in the housing.

18 Claims, 7 Drawing Sheets

(56) References Cited

U.S. PATENT DOCUMENTS

| | | | | |
|---|---|---|---|---|
| 8,567,494 | B2 | 10/2013 | Rytlewski et al. | |
| 8,936,085 | B2 | 1/2015 | Boney et al. | |
| 9,016,388 | B2 | 4/2015 | Kellner et al. | |
| 2016/0069155 | A1 | 3/2016 | Todd et al. | |
| 2016/0084035 | A1 | 3/2016 | Sommers | |
| 2016/0201432 | A1 | 7/2016 | Holcomb et al. | |
| 2017/0138162 | A1 | 5/2017 | Lynk | |
| 2017/0335645 | A1 | 11/2017 | Merron et al. | |
| 2019/0032435 | A1* | 1/2019 | Kochanek | E21B 33/12 |
| 2019/0249516 | A1* | 8/2019 | Riha | E21B 33/138 |

* cited by examiner

ZONAL ISOLATION OF A SUBTERRANEAN WELLBORE

BACKGROUND

1. Field

The present disclosure relates generally to stimulating production from a subterranean wellbore. More specifically, the present disclosure relates to isolating a zone in a wellbore with a non-dissolving plug assembly.

2. Related Art

Hydrocarbon producing wellbores extend subsurface and intersect subterranean formations where hydrocarbons are trapped. Drilling systems are typically used to excavate the wellbores that include drill bits that are on the end of a drill string, and a drive system above the opening to the wellbore that rotates the drill string and bit. Cutting elements on the drill bit scrape the bottom of the wellbore as the bit is rotated, and excavate rock from the formation thereby deepening the wellbore. During drilling operations, drilling fluid is normally pumped down the drill string and discharged from the drill bit into the wellbore. The drilling fluid flows back up the wellbore in an annulus between the drill string and walls of the wellbore. Cuttings produced while excavating are carried up the wellbore with the circulating drilling fluid.

Some wells are subjected to a fracturing process, which initiate cracks at the wellbore wall that turn into fractures which project radially outward into the formation. The fractures are meant to increase drainage volume from the formation into the wellbore, to in turn increase hydrocarbon production from the formation. Fracturing is typically performed by injecting high pressure fluid into the wellbore and sealing off a portion of the wellbore. Fracturing initiates when the pressure in the wellbore exerts a force onto the rock that exceeds its strength in the formation. For various reasons, usually only a portion of a well is pressurized at a single time so that fractures are formed in a designated zone of the formation with each stage in the fracturing process. Plugs and or packers are typically deployed in the well to isolate the portion of the well to be pressurized. Plugs often are annular members, and form a pressure barrier in the well by landing a ball or other object within the plug. The plugs and the landed ball/object are usually removed with a drill bit after the fracturing process. Some plug assemblies employ balls that dissolve when exposed to the wellbore environment. However, the fracturing process sometimes deforms a casing that lines the wellbore, and impedes a drill bit from reaching the plug. Also, the dissolving balls degrade before completing the fracturing process and the designated zone is no longer isolated.

SUMMARY

Disclosed is an example method of wellbore operations that includes setting an annular housing within a wellbore, sealing an annulus between the housing and sidewalk of the wellbore, landing a ball on the housing that blocks pressure communication through a bore axially formed through the housing, generating fractures in a formation that circumscribes the wellbore by pressurizing a portion of the wellbore uphole of the ball, providing pressure communication through the bore in the housing by fragmenting the ball, and inserting a downhole tool through the bore in the housing. A wellhead assembly is optionally disposed at an opening of the wellbore, and which has a main bore; in this example the method includes isolating the main bore from pressurized fluid that is used to pressurize the portion of the wellbore. The step of isolating can include inserting a tubular member into the main bore after the ball is landed on the housing and before fractures are generated in the formation, and wherein the ball is not reactive with fluid in the wellbore. In one embodiment the annular housing and a seal for sealing the annular between the housing and sidewalls of the wellbore form a plug assembly. In an alternative, the plug assembly is disposed in the wellbore as part of a downhole string that further has a setting tool and a perforating gun. An optional step of the method includes forming perforations in the sidewalls of the wellbore with the perforating gun. In certain embodiments the ball is made of metal and the step of fragmenting the ball from the housing includes contacting the ball with a drill bit, and wherein the drill bit is insertable through the bore in the housing. Alternatively, the ball is made of ceramic and the step of fragmenting the ball from the housing involves fracturing the ball with an applied force. In an embodiment, pressurizing a portion of the wellbore uphole of the ball urges a section of casing that lines the wellbore radially inward, and wherein a bottom hole assembly having a designated size is disposed into the wellbore and navigated past the section of casing that is urged radially inward. The bottom hole assembly is alternatively used to fragment the ball. In an example, an outer diameter of the ball ranges from about 80% to about 90% of an inner diameter of a casing that lines the wellbore.

Another example method of wellbore operations includes setting a plug assembly at a designated depth within a wellbore, using a ball to block pressure communication across the plug assembly, breaking the ball into fragments that pass through a bore in the plug assembly, and inserting a downhole string through the bore in the plug assembly. Embodiments exist where the ball is fragmented during the step of reestablishing pressure communication comprises, so that fragments of the ball pass through a bore in the plug assembly. Further optionally included in the method is a step of fracturing a formation circumscribing the wellbore with pressurized fluid that urges the ball against the plug assembly. One embodiment of the downhole string includes a tubular and a downhole tool, such as a drill bit, a junk basket, a bottom hole assembly, or a wash nozzle assembly. Embodiments exist where the plug assembly has a bore having an inner diameter that ranges from about 75% to about 85% of a diameter of a casing that lines the wellbore.

Yet another example method of wellbore operations disclosed here includes providing a plug assembly having a bore with an inner diameter of about 3 inches, setting the plug assembly within a wellbore that is lined with casing having an inner diameter that ranges from about 3.9 inches to about 4.7 inches, providing a ball having an outer diameter of about 3.25 inches to about 4 inches and that is non-reactive with fluids in the wellbore, landing the ball on the plug assembly, fracturing a formation circumscribing the wellbore with pressurized fluid that urges the ball against the plug assembly, fragmenting the ball with a downhole string, and inserting the downhole string through the bore in the plug assembly. The method further optionally includes isolating a wellhead assembly from the pressurized fluid by installing an isolation tool, and wherein the during the step of installing the isolation tool the ball is disposed in fluid in the wellbore and is non-reactive with the fluid.

DESCRIPTION OF DRAWINGS

Some of the features and benefits of the present invention having been stated, others will become apparent as the description proceeds when taken in conjunction with the accompanying drawings, in which.

DETAILED DESCRIPTION

Figure 1:
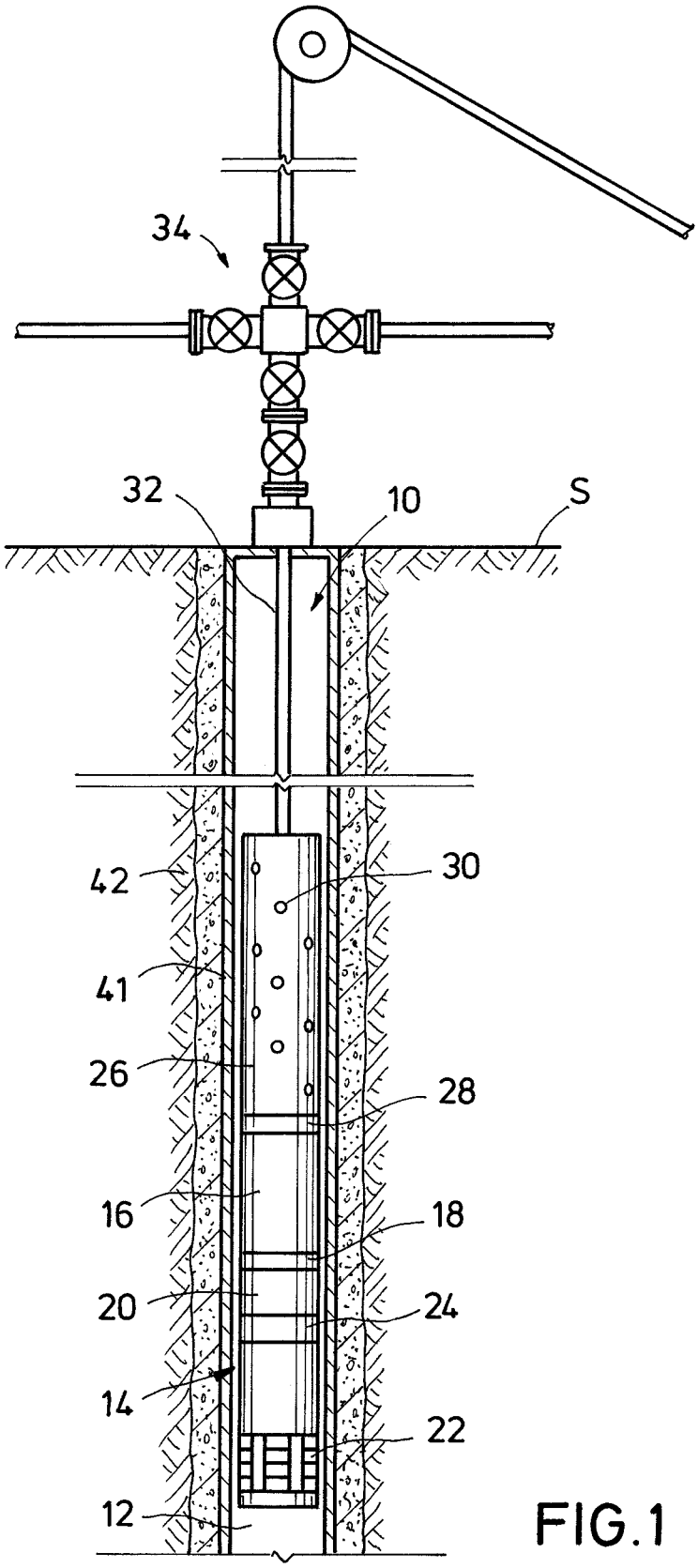
FIG. 1 is a side sectional view of an example of a downhole string disposed in a wellbore.

The method and system of the present disclosure will now be described more fully after with reference to the accompanying drawings in which embodiments are shown. The method and system of the present disclosure may be in many different forms and should not be construed as limited to the illustrated embodiments set forth; rather, these embodiments are provided so that this disclosure will be thorough, complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, materials, or embodiments shown and described. Modifications and equivalents will be apparent to one skilled in the art. Illustrative examples have been disclosed in the drawings and specification. Although specific terms are employed they are used in a generic and descriptive sense only and not for the purpose of limitation.

One example of a downhole string disposed in a wellbore 12 is shown in a side sectional view in FIG. 1. The string 10 includes a bore plug 14 and which is coupled to a setting tool 16 by a connector sub 18. The bore plug 14 includes an annular housing 20 and that is circumscribed by anchor slips 22 around its outer periphery. The mid portion of housing 20 has a seal 24 along its outer diameter and which is selectively deployed for sealing an annular space between bore plug 14 and sidewalk of wellbore 12. A perforating gun 26 is further included with the example of the string 10, and which is on a side of setting tool 16 opposite from bore plug 14. Gun 26 couples with setting tool 16 by connector sub 28. Perforating gun 26 is equipped with a number of shaped charges 30 that are shown arranged within a housing of gun 26, and having open ends facing radially outward from perforating gun 26. In an example, shaped charges 30 each include a casing (not shown), with high explosive disposed in a cavity of casing, and a liner on a side of high explosive opposite from cavity and housing. Downhole string 10 is deployed in wellbore 12 via conveyance means 32, which is illustrated as an elongated member that routes over a sheave and intersects a main bore within a wellhead assembly 34 mounted on the surface. Examples of conveyance means 32 include tubing, coiled tubing, wireline, slickline, cable, and the like.

Figure 2:
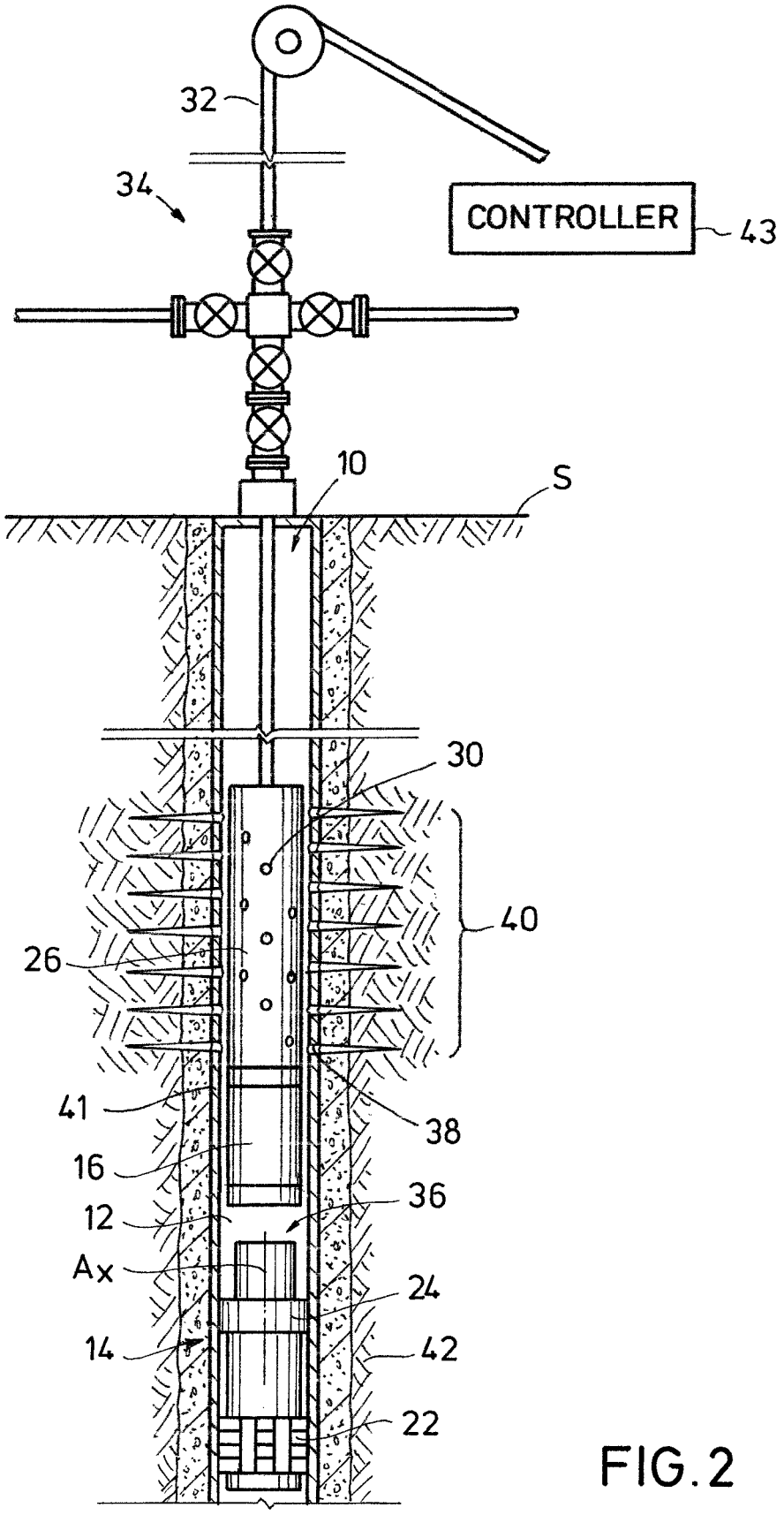
FIG. 2 is a side sectional view of an example of perforating the wellbore of FIG. 1 with a perforating gun on the downhole string.

Shown in a side sectional view in FIG. 2 is an example step of wellbore operations where bore plug 14 is landed within wellbore 12 and separated from the remaining portion of string 10. In an example, setting tool 16 is activated to deploy the anchor slips 22 into engagement with sidewall of wellbore 12 for supporting the bore plug 14 within wellbore 12. Further in this example, seal 24 is shown radially expanded to form a sealing interface between the bore plug 14 and inner surface of wellbore 12. In the example of FIG. 2, a bore 36 is shown extending axially through bore plug 14 and along its axis Ax.

Another step of wellbore operations is illustrated in FIG. 2 and where shaped charges 30 are initiated into detonation and which form jets 38 that project radially outward from the perforating gun 26. The jets 38 form perforations 40 that extend from a wall of wellbore 12 and radially outward into a formation 42 that circumscribes wellbore 12. A controller 43 is schematically illustrated outside of wellbore 12 and on surface 5, which one example provides a means for communicating with string 10 from surface S and via conveyance means 32. In an alternate example, commands for initiating detonation of shaped charges 30 are sent from controller 43.

Figure 3:
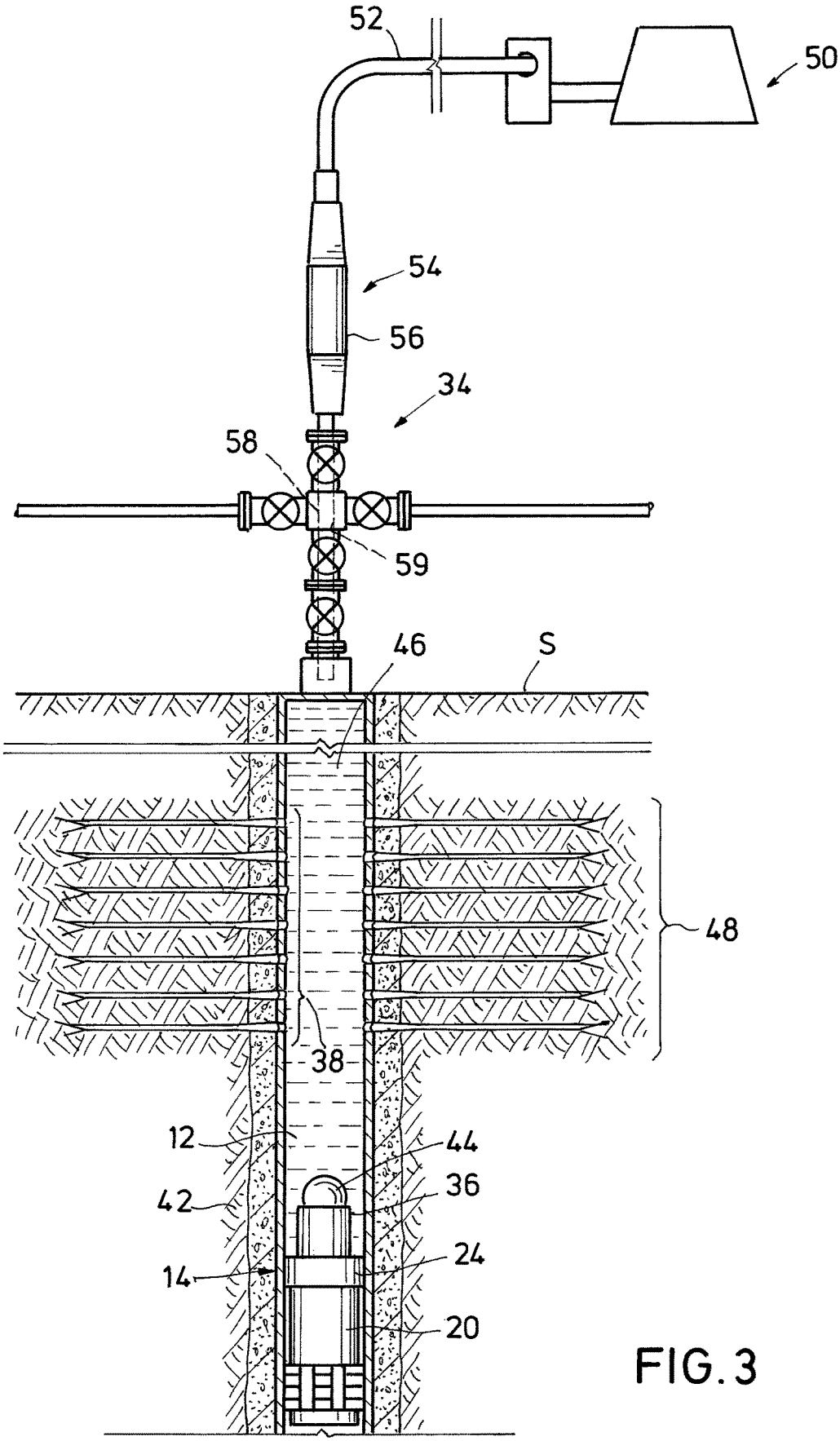
FIG. 3 is a side sectional view of an example of perforating a section of the wellbore of FIG. 1.

Shown in side sectional view in FIG. 3 is an example step of wellbore operations, that in an example occurs subsequent to the perforating step depicted in FIG. 2. Here a ball 44, that was inserted into wellbore 12 via wellhead assembly 34, is shown landed on bore plug 14. Landing ball 44 as shown blocks pressure communication through bore 36 and the housing 20 of the bore plug 14. Subsequent to landing ball 44 on bore plug 14, fluid 46 is introduced into wellbore 12. The combination of the ball 44 over bore 36 and seal 24 form a pressure barrier axially across bore plug 14. Accordingly, pressure within the wellbore 12 and uphole of the bore plug 14 approaches that of the fluid 46. Applying fluid 46 at a sufficient pressure to overcome the yield strength of the rock making up formation 42 forms fractures 48 in the formation 42. For the purposes of discussion herein, the fractures 48 formed at a particular depth and with a cycle of pressurized fluid 46 are referred to as a set of fractures. Example fractures 48 created by the pressurized fluid 46 in the formation 42 are shown extending from the outer ends of perforations 38 already formed in formation 42. An example of a fluid pump 50 for pressurizing fluid 46 at a pressure sufficient for creating fractures 48 within formation 42 is schematically illustrated. In this example, pump 50 is outside of wellbore 12 and on surface S. Fluid 46 being pressurized by the fluid pump 50 is discharged into a line 52 for delivery into wellbore 12.

To protect the wellhead assembly 34 from the high pressures of the fluid 46, an optional isolation device 54 is included at a terminal end of line 52 and adjacent wellhead assembly 34. Isolation device 54, which is sometimes referred to as a tree saver, includes a body 56 having one end attached to line 52, and an opposite end attached to an upper terminal end of wellhead assembly 34. Further included with isolation device 54 is an annular sleeve 58 shown in dashed outline, and which inserts into a main bore 59 of the wellhead assembly 34. A lower terminal end of the sleeve 58 extends past wellhead assembly 34, thereby fully isolating wellhead assembly 34 from pressure in fluid 46. In the example illustrated, ball 44 is formed from a ceramic, or a metal, and which is not reactive with the fluid 46, or degradable due to the operating conditions, i.e., temperature or pressure, that are present within wellbore 12. As such, during the time necessary for installing the isolation device 54 onto wellhead assembly 34, and while ball 44 is disposed in wellbore 12, the ball 44 is not mechanically degraded and maintains its integrity as when initially introduced into wellbore 12. Accordingly, the ball 44 is fully functional as a pressure barrier after the time required for installing isolation device 54.

Figure 4:
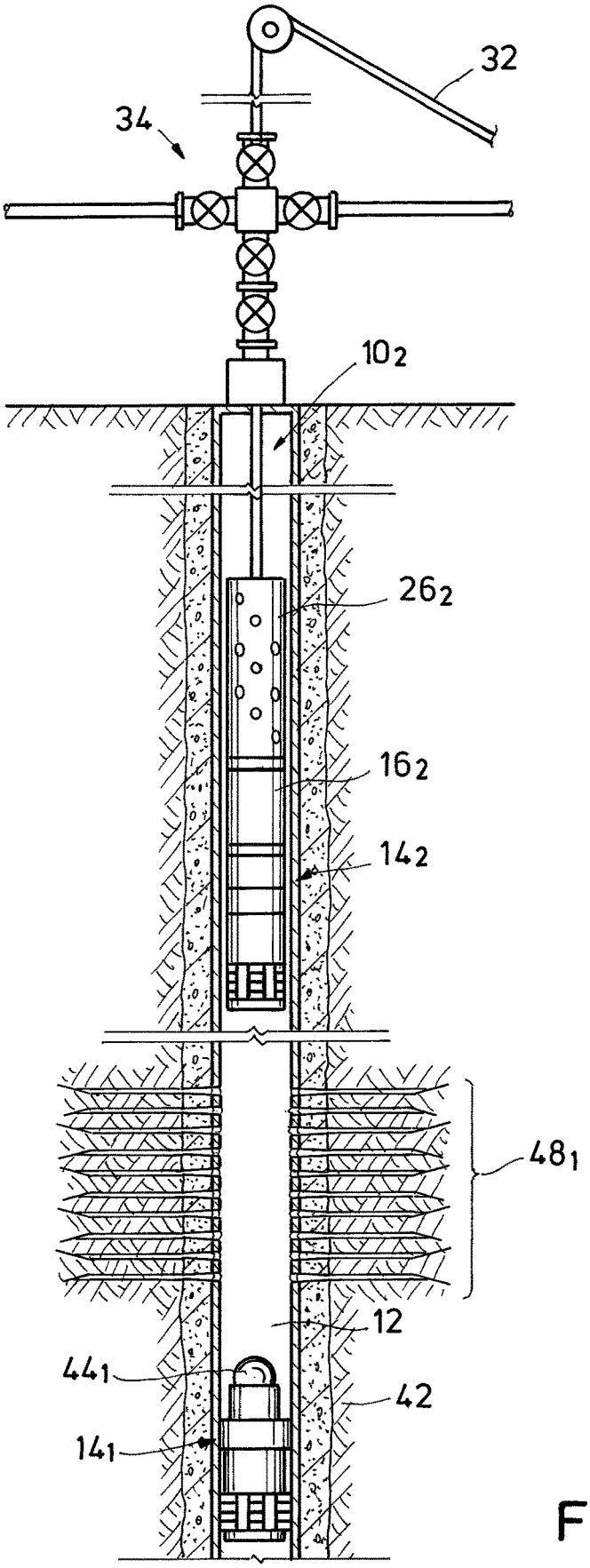
FIG. 4 is a side sectional view of an example of disposing an additional downhole string in the wellbore of FIG. 1.

Referring now to FIG. 4, shown in a side sectional view is an example step in an embodiment of wellbore operations described herein. In this example, a second downhole string 102 is being inserted within wellbore 12 after a first bore plug $\mathbf{14}_1$ and ball $\mathbf{44}_1$ are set and landed within wellbore 12, and also after the fractures $\mathbf{48}_1$ have been formed within formation 42. In the example of FIG. 4 string $\mathbf{10}_2$ includes a second bore plug $\mathbf{14}_2$, a second setting tool $\mathbf{16}_2$, and a second perforating gun $\mathbf{26}_2$. Embodiments exist where setting tool $\mathbf{16}_2$ is the same as setting tool 16 of FIG. 1. In one example, the steps of wellbore operations illustrated in FIGS. 1-4 are repeated to generate multiple sets of fractures at designated depths in the wellbore 12, and which may be in the same or different zones in the formation 42.

Figure 5:
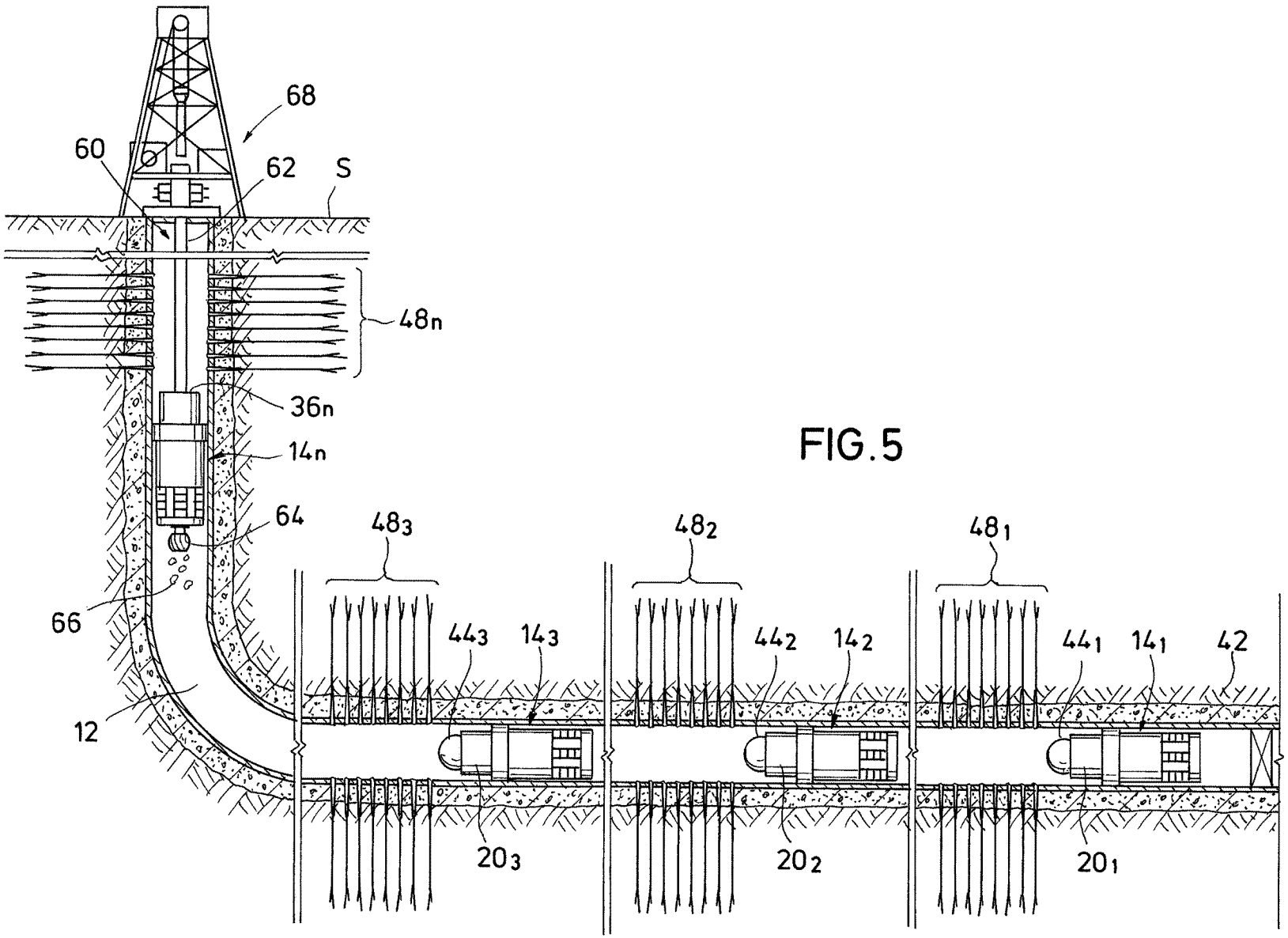
FIG. 5 is a side sectional view of an example of using a drilling system to remove balls from within plug assemblies set in the wellbore of FIG. 1.

Shown in side sectional view in FIG. 5 is where a number of stages of fracturing have taken place so that multiple sets of fractures $\mathbf{48}_{1\text{-}n}$ are formed in formation 42. Accordingly, disposed within wellbore 12 are the bore plugs $\mathbf{14}_{1\text{-}n}$ and their associated balls $\mathbf{44}_{1\text{-}3}$. An example of a milling string 60 is provided in FIG. 5, and which includes tubing 62 located on its upper end, that is rotated such as by a rotary table or top drive. A drill bit 64 is included with string 60, and which is shown on an end of tubing 62 disposed in wellbore 12. Drill bit 64 rotates with rotation of tubing 62, and as illustrated is passing through bore plug $\mathbf{14}_n$. While in bore plug $\mathbf{14}_n$, bit 64 mechanically fragmented ball (not shown) that had previously landed on bore plug $\mathbf{14}_n$. Further shown in FIG. 5, is that the example process of milling through bore plug $\mathbf{14}_n$ created fragments 66 that drop downhole from the bore plug $\mathbf{14}_n$. A drilling unit 68 is shown on surface S and which provides controls and power for rotating string 60. Thus in one example illustrated in FIG. 5, the string 60 is further extended within wellbore 12 and used for milling or otherwise removing balls $\mathbf{44}_{1\text{-}3}$ from their associated bore plugs $\mathbf{14}_{1\text{-}n}$. Moreover, the dimensions of the bit 64 and tubing 62 are such that passage within the bores $\mathbf{36}_{1\text{-}3}$ is possible without damaging the respective housings $\mathbf{20}_{1\text{-}3}$ of the bore plugs $\mathbf{14}_{1\text{-}n}$. Additional example methods of removing balls from the bore plugs $\mathbf{14}_{1\text{-}n}$ include fracturing the balls by applying an impulse force, or any other technique that fragments the balls for removal from bore plugs $\mathbf{14}_{1\text{-}n}$.

Figure 6:
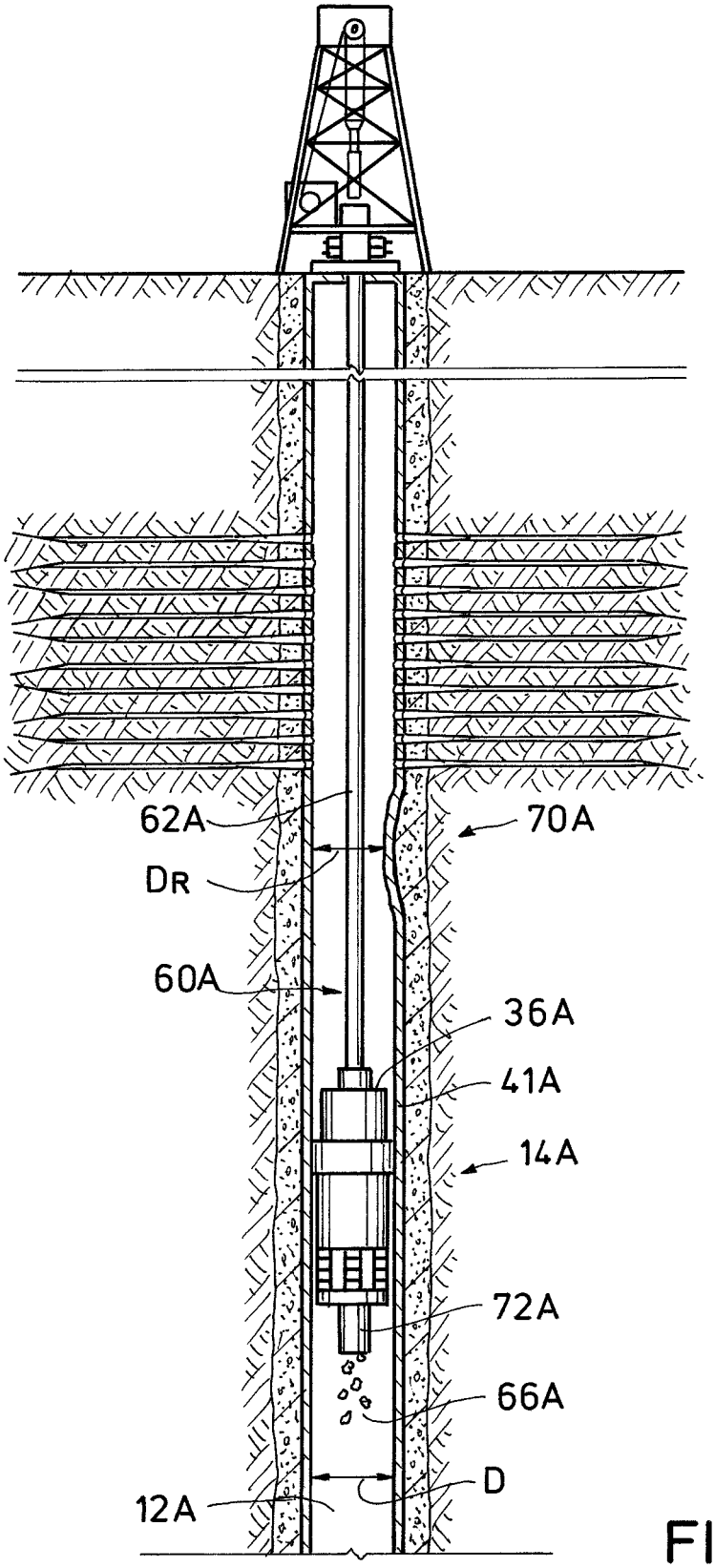
FIG. 6 is a side sectional view of an alternate example of removing balls from the plug assemblies of FIG. 5.

Shown in side sectional view in FIG. 6 is one example of wellbore operations where seismic activity during fracturing operations has generated forces that formed a deformed portion 70A within casing 41A. As shown, the deformed portion 70A projects radially inward into the wellbore and reduces its inner diameter. In some examples, the reduced diameter of wellbore 12A prohibits passage of some milling devices. In this example, a reduced size bottomhole assembly 72A is deployed within wellbore 12A and for fragmenting ball (not shown) formerly set on top of bore plug 14A. Fragments 66A are shown passing through the bore 36A of bore plug 14A and dropping downhole within wellbore 12A.

Figure 7:
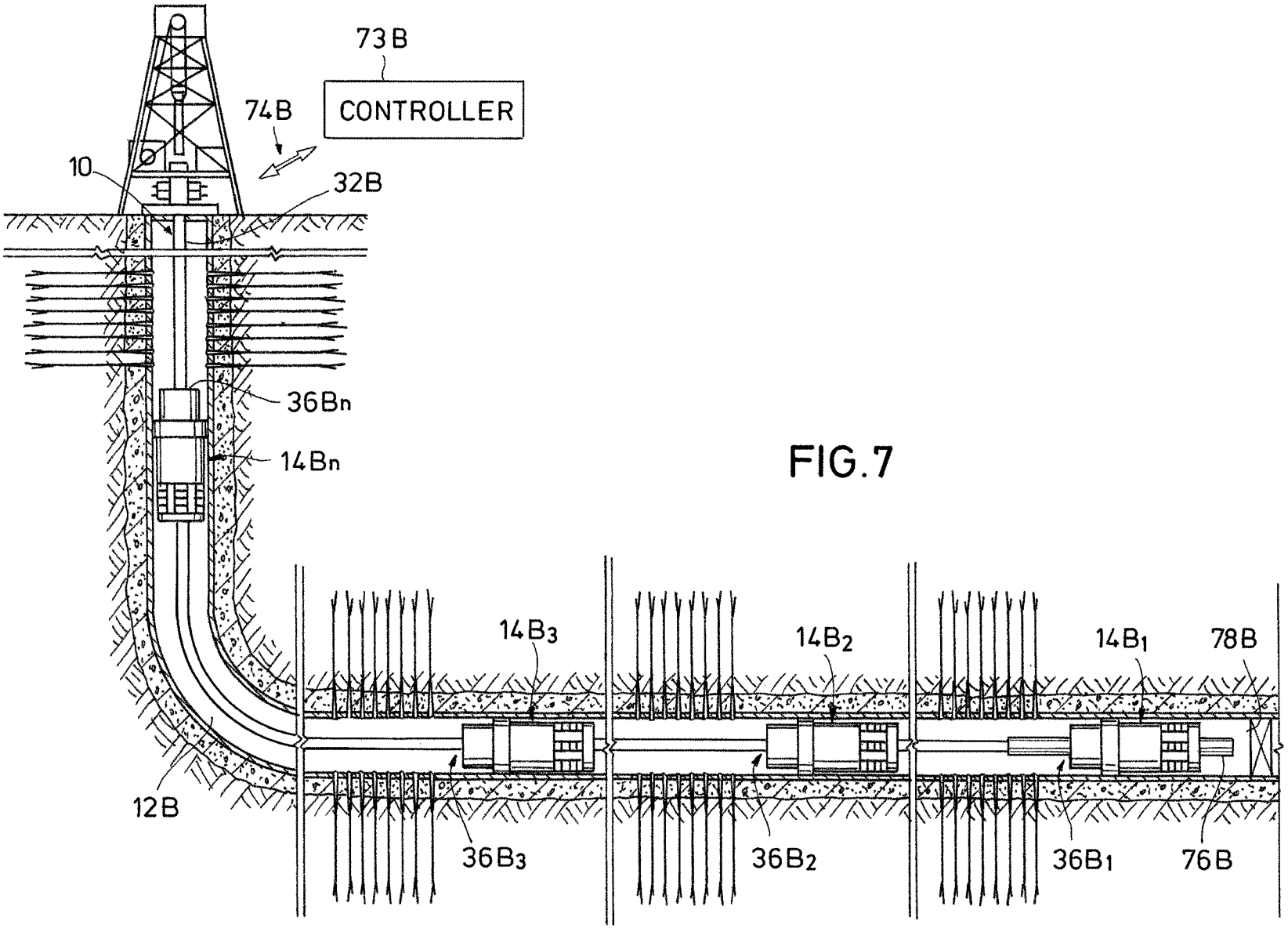
FIG. 7 is a side sectional view of an example of conducting wellbore operations in the wellbore of FIG. 5 with a downhole tool that inserts through the plug assemblies.

Referring now to FIG. 7, shown in a partial side sectional view is an example of wellbore operations where a downhole string 10 is deployed within wellbore 12B. Downhole string 10 of FIG. 7 includes a downhole tool 76B on a lower end of conveyance means 32B. Further in this example of wellbore operations, the downhole tool 76B has been negotiated through bores $\mathbf{36}\mathrm{B}_{1\text{-}n}$ in each of the bore plugs $\mathbf{14}\mathrm{B}_{1\text{-}n}$, and so that the tool is proximate a bottom 78B of wellbore 12B. In an example, the dimensions of the bore plugs $\mathbf{14}\mathrm{B}_{1\text{-}n}$ allow for wellbore operations to continue after steps of fracturing, and their associated balls (not shown) have been removed. In one example, the casing lining wellbore 12B ranges from about 3.9 inches to about 4.7 inches inner diameter. The bore plugs $\mathbf{14}\mathrm{B}_{1\text{-}n}$ have bores $\mathbf{33}\mathrm{B}_{1\text{-}n}$ that have a diameter of about 3 inches to about 3.75 inches. Referring back to FIG. 5, balls $\mathbf{44}_{1\text{-}3}$ have outer diameters that range up to about 3.25 inches to about 4 inches. Accordingly, the advantage of deploying the bore plugs 14 described herein is that balls $\mathbf{44}_{1\text{-}3}$ are used that have an outer diameter ranging from about 80% to about 90% of an inner diameter of a casing lining in wellbore. A further advantage is that balls are mechanically removed from the bore plugs without the need to remove the bore plugs from inside the casing that lines the wellbore 12B, and yet the bore plugs $\mathbf{14}\mathrm{B}_{1\text{-}n}$ have sufficiently sized diameters so that continued wellbore operations are possible.

The present disclosure therefore is well adapted to carry out the objects and attain the ends and advantages mentioned, as well as others inherent. While embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method of wellbore operations comprising:

setting an annular housing within a wellbore;

sealing an annulus between the housing and sidewalls of the wellbore;

landing a ball on the housing that blocks pressure communication through a bore axially formed through the housing;

generating fractures in a formation that circumscribes the wellbore by pressurizing a portion of the wellbore uphole of the ball;

providing pressure communication through the bore in the housing by fragmenting the ball;

after landing the ball on the housing and prior to generating the fractures, inserting a tubular member into a main bore of a wellhead assembly that is disposed at an opening of the wellbore to isolate the main bore from the wellbore; and inserting a downhole tool through the bore in the housing.

2. The method of claim 1, wherein the main bore is isolated from pressurized fluid that is used to pressurize the portion of the wellbore.

3. The method of claim 1, wherein the ball is not reactive with fluid in the wellbore.

4. The method of claim 1, wherein the annular housing and a seal for sealing the annulus between the annular housing and sidewalls of the wellbore comprise a plug assembly.

5. The method of claim 4, wherein the plug assembly is disposed in the wellbore as part of a downhole string that further comprises a setting tool and a perforating gun.

6. The method of claim 5, further comprising forming perforations in the sidewalls of the wellbore with the perforating gun.

7. The method of claim 1, wherein the ball comprises metal and the step of fragmenting the ball from the housing comprises contacting the ball with a drill bit, and wherein the drill bit is insertable through the bore in the housing.

8. The method of claim 1, wherein the ball comprises ceramic and the step of fragmenting the ball from the housing comprises fracturing the ball with an applied force.

9. The method of claim 1, wherein pressurizing a portion of the wellbore uphole of the ball urges a section of casing that lines the wellbore radially inward, and wherein a bottom hole assembly having a designated size is disposed into the wellbore and navigated past the section of casing that is urged radially inward.

10. The method of claim 9, wherein the bottom hole assembly is used to fragment the ball.

11. The method of claim 1, wherein an outer diameter of the ball ranges from about 80% to about 90% of an inner diameter of a casing that lines the wellbore.

12. A method of wellbore operations comprising:

setting a plug assembly at a designated depth within a wellbore;

using a ball to block pressure communication across the plug assembly;

isolating a main bore of a wellhead assembly that is mounted over the wellbore by inserting a tubular member into the main bore;

breaking the ball into fragments that pass through a bore in the plug assembly; and inserting a downhole string through the bore in the plug assembly.

13. The method of claim 12, wherein the main bore is isolated after pressure communication across the plug assembly is blocked and prior to fracturing the ball.

14. The method of claim 12, further comprising fracturing a formation circumscribing the wellbore with pressurized fluid that urges the ball against the plug assembly.

15. The method of claim 12, wherein the downhole string includes a tubular and a downhole tool that comprises a device selected from the group consisting of a drill bit, a junk basket, a bottom hole assembly, and a wash nozzle assembly.

16. The method of claim 12, wherein the plug assembly comprises a bore having an inner diameter that ranges from about 75% to about 85% of a diameter of a casing that lines the wellbore.

17. A method of wellbore operations comprising:

providing a plug assembly having a bore with an inner diameter of about 3 inches to about 3.75 inches;

setting the plug assembly within a wellbore that is lined with casing having an inner diameter that ranges from about 3.9 inches to about 4.7 inches;

providing a ball having an outer diameter of about 3.25 inches to about 4 inches;

landing the ball on the plug assembly;

fracturing a formation circumscribing the wellbore with pressurized fluid that urges the ball against the plug assembly;

isolating a wellhead assembly at an opening of the wellbore from the pressurized fluid by inserting a sleeve into a main bore of the wellhead assembly after landing the ball on the plug assembly and prior to fracturing the formation;

fragmenting the ball with a downhole string; and inserting the downhole string through the bore in the plug assembly.

18. The method of claim 17, wherein during the step of installing the sleeve the ball is disposed in fluid in the wellbore and is non-reactive with the fluid.

* * * * *